US005579941A

United States Patent [19]

Romick

[11] Patent Number: 5,579,941

[45] Date of Patent: Dec. 3, 1996

[54] MEDICATION CONTROL AND DISPENSING PACKAGE ASSEMBLAGE

[76] Inventor: Jerome M. Romick, 4800 Hilton Corp. Dr., Columbus, Ohio 43232

[21] Appl. No.: 306,576

[22] Filed: Sep. 15, 1994

Related U.S. Application Data

[63] Continuation-in-part of Ser. No. 16,249, Feb. 11, 1993, Pat. No. 5,437,390.

[51] Int. Cl.[6] ..... A47G 19/00; B65D 21/02

[52] U.S. Cl. ..... 220/23.86; 220/212.5; 220/528; 220/729; 220/759; 229/117.19; 229/117.23; 206/538

[58] Field of Search ..... 220/23.83, 23.86, 220/212, 212.5, 334, 528, 729, 759, 768, 260, 263; 229/117.19, 117.23; 206/532, 538

[56] References Cited

U.S. PATENT DOCUMENTS 4,741,441 5/1988 Keffeler ..... 206/532
4,813,753 3/1989 Relyea ..... 312/291
5,011,018 4/1991 Keffeler ..... 206/532
5,108,004 4/1992 Baldwin ..... 220/522

*Primary Examiner*—Stephen K. Cronin
*Attorney, Agent, or Firm*—Vorys, Sater, Seymour & Pease

[57] ABSTRACT

An improved medication dispensing and control assembly is disclosed in which a carton has sidewalls defining a medication dispensing opening, which carton has at least one sidewall provided with a positioning slot for secure positioning in a tray. The carton has bendable top wall connected to the sidewalls to allow the top wall to move between a position closing the medication opening and opened positions allowing removal of medication from the cartons. A frame may be releasably attached to the top wall (for instance by teeth or other projections) so as to maintain planarity of the top wall to thereby facilitate carton opening and closing and maintaining the top wall portion in a closed condition and to resist any undesired bending thereof. The tray may be provided with anchoring tabs for slidable engagement with the positioning slot of the carton, thereby securing the carton in the tray while still allowing easy removal, and the carton may be provided with closing flaps to secure the carton in a closed position.

7 Claims, 7 Drawing Sheets

MEDICATION CONTROL AND DISPENSING PACKAGE ASSEMBLAGE

This application is a continuation-in-part of U.S. patent application Ser. No. 08/016,249 filed Feb. 11, 1993, now U.S. Pat. No. 5,437,390.

BACKGROUND OF THE INVENTION

The present invention relates generally to a medication control and dispensing assembly and, in particular, to such an assembly including an improved combination of a container lid frame attachment and associated drug dispensing container.

In the medical dispensing field, a wide variety of approaches exist for assuring that the patient receives their medication from medication dispensing devices. One known dispensing system includes a medication containing and dispensing carton. Typically, these cardboard cartons are filled by a pharmacist with medicine arranged in doses. Thereafter, the cartons are sealed and labeled by the pharmacist for subsequent use. Generally, each carton is opened by a nurse or other person in charge of dispensing the medicine. In this regard, the carton is provided with a top or lid which when in the open condition defines a medication dispensing opening. Usually, the upper surface of the lid contains a label from the pharmacist so that the medication can be properly dispensed. During the dispensing of medication from these cartons, if the lids are not closed properly there is a chance of spilling or other inadvertent transfers of medication from one carton to adjacent cartons when such cartons are mounted in adjacent relationship. In addition, it is desirable to have the full dimensions of the dispensing opening available for dispensing of the contents so as to facilitate medicine dispensing. However, sometimes the carton lids can be bent or sometimes crushed, therefore inhibiting dispensing and otherwise minimizing the capacity of the dispensing system.

Another known approach for drug control and dispensing is described in U.S. Pat. No. 4,813,753. This approach relates to the use of a combination of a carton containing medicine and a releasably attachable tray lid attachable to the top flap of each carton. The lid is connectable to the top flap and includes a pair of hinge elements that are required for pivotal mounting on a tray for the device to operate as intended. In this regard, the tray is also formed with tray lid supporting structure for allowing the tray lid to pivot. Drawbacks associated with this approach are that it is rather cumbersome for the nurse to use. For instance, the nurse is continually involved with attaching and releasing the carton top to the tray lid during use of the carton. In this regard, the carton with a reorder label on it must first be attached to the tray lid and to do this the nurse must flex the box lid to attach the box lid to the tray lid. When it is time to reorder the drugs, the reorder label strip on the carton is used. However, to obtain this label, the nurse must release the carton lid from the tray lid, which covers and obscures the reorder label, and then remove the reorder label. Since the tray lid covers the reorder label, access to the label can only occur by releasing the box lid that is attached beneath the plastic tray lid. Thereafter, the nurse must reattach the carton lid to the tray lid in a manner as noted before.

Moreover, in any type of tray system if the tray is not entirely filled with its full capacity of cartons, the cartons may undesirably slide in the tray, particularly in a front-to-back direction. The cartons may by frictional force between the cartons be held in proper place when the tray is full, but if the tray is not full, there is front-to-back play which gets worse as the number of cartons inserted in the tray decreases. If only one or two cartons remain in the tray, they may even be loose enough to spill out if the tray is inclined during transport or storage.

Additionally, a basic tray approach like that described above is expensive to manufacture because of its several costly components, and the releasable attachment structure is not entirely reliable. Flexing of the sidewalls of the tray during normal handling can cause the plastic lid tabs to release from the tray. Plastic tabs on the lids also are subject to breakage during use which renders the system inoperable as it was designed.

Accordingly, there is a continuing desire to improve upon the drawbacks noted in the prior art by providing an improved medication control and dispensing package assembly.

SUMMARY OF THE INVENTION

The present invention relates to an improved medication dispensing package assembly. Included is a medication control and dispensing assembly comprising: a medication dispensing carton having walls defining a medication dispensing opening, and a top wall portion made of bendable material and being connected to a portion of the walls in such a manner so as to be movable between a closed condition covering the medication opening and open conditions so as to permit withdrawal of medication from the carton. The top wall portion has connecting means adapted to be connected to a frame means. At least one side wall portion of the carton is provided with a position slot for cooperative mating with a anchoring tab as described hereinafter.

In combination with the carton is a frame means having locking means removably coupleable with the connecting means and the frame means cooperates with the top wall portion for retaining the configuration of the top wall portion, thereby facilitating easy opening and closing of the bendable top wall portion and for supporting the top wall portion in such a manner so as to resist undesired bending thereof. The frame means further includes anchoring tabs at interior positions of side walls of the frame means, positioned to be inserted into corresponding position slots of inserted cartons.

In another illustrated embodiment, the assembly further comprises an open top tray for removably supporting at least one of the medication dispensing cartons.

In another illustrated embodiment, the frame means includes at least a pair of spaced-apart locking tab projections which extend through openings in the top wall portion and removably cooperate with the underside surface of the top wall portion.

In another illustrated embodiment provision is made for a releasable frame assembly adapted for cooperative use with a medication dispensing carton, wherein the carton has walls defining a medication dispensing opening, and a top wall portion made of bendable material and being connected to a portion of the walls in such a manner as to be movable between a closed condition covering the medication opening and open conditions which permits withdrawal of medication from the carton. In this embodiment the top wall portion has connecting means associated therewith which is adapted to be connected to a frame assembly. The frame assembly comprises releasably locking means for removable coupling to the connecting means of the top wall portion and is constructed for cooperating with the top wall portion for retaining the configuration of the top wall portion, thereby facilitating easy opening and closing of the top wall portion and for supporting the top wall portion in such a manner so as to resist undesired bending thereof.

Accordingly among the objects of the present invention are the following: an improved drug control and dispensing assembly which facilitates proper dispensing of medication from a medication container; an improved drug control and dispensing assembly which is reliable and easy to use; an improved drug control and dispensing assembly which is inexpensive to manufacture and assemble; an improved drug control and dispensing assembly which includes an open top tray for at least a single container; an improved drug control and dispensing assembly which facilitates effective use in a medical cart; an improved drug control and dispensing assembly which tends to maintain the structural integrity of the top flap portion as well as the carton body structure; an improved drug control and dispensing assembly which maintains the inserted cartons in secure positions in the tray, yet allows convenient removal of individual cartons; an improved frame assembly for use in association with a bendable top portion of a medication dispensing carton; an improved frame assembly as last noted which is easy to securely attach to a bendable top flap portion of a carton; an improved frame assembly which allows convenient access to the re-order label without obscuring it.

Other objects and further scope of applicability of the present invention will become apparent from the detailed description to follow when taken in conjunction with the accompanying drawings in which like parts are designated by like reference numerals throughout the several views.

DETAILED DESCRIPTION OF THE DRAWINGS

Figure 1:
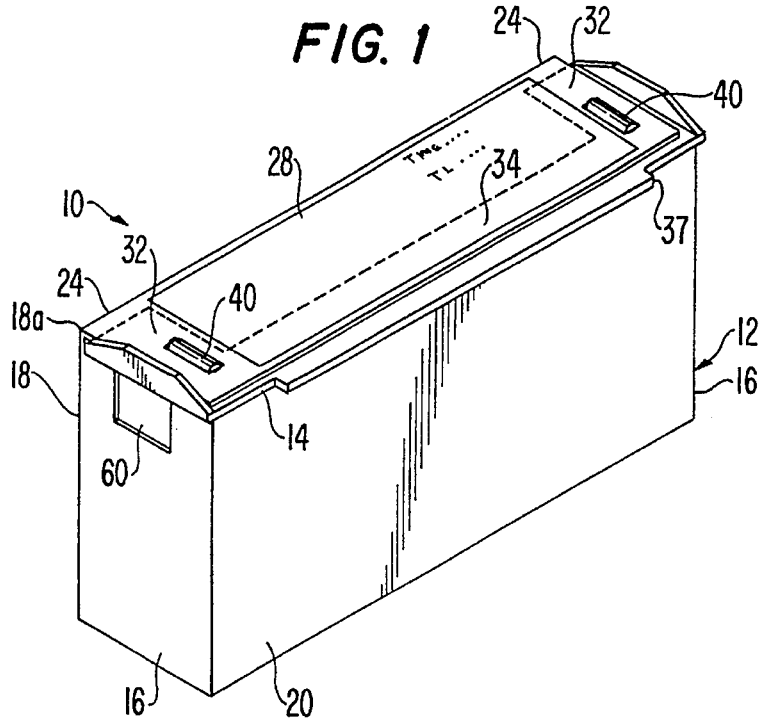
FIG. 1 is a perspective view of a medication control and dispensing assembly according to the present invention.
Figure 2:
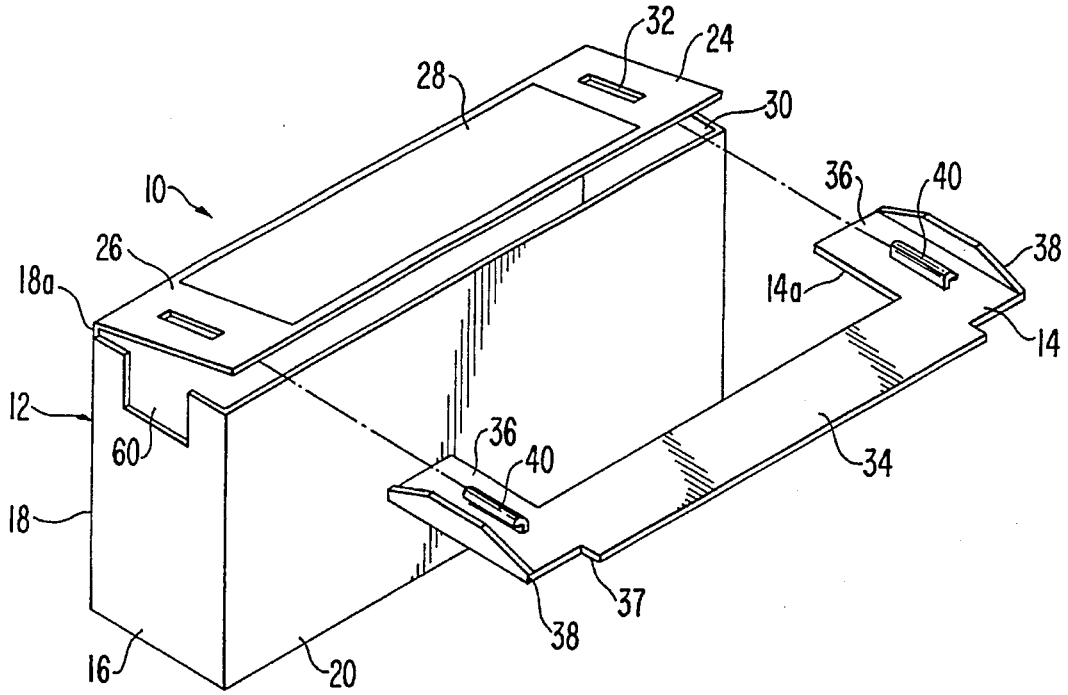
FIG. 2 is an exploded perspective view illustrating the components of the control and dispensing assembly in a disassembled condition.
Figure 3:
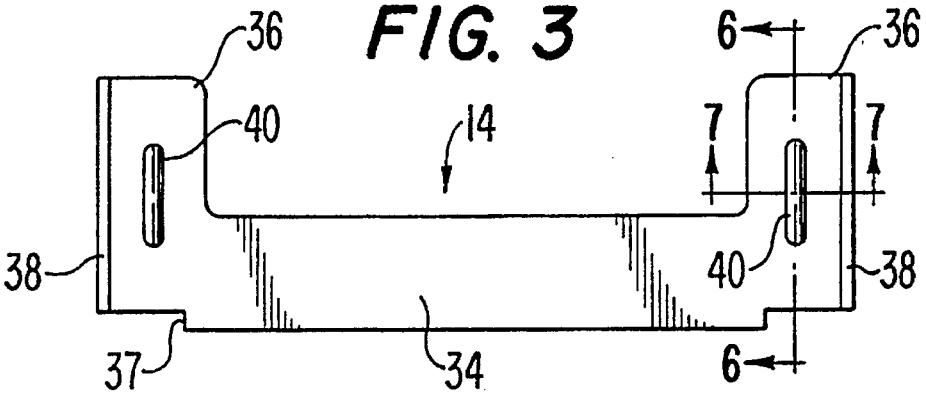
FIG. 3 is a bottom view of a frame assembly forming one aspect of the drug control and dispensing assembly of the present invention.
Figure 4:
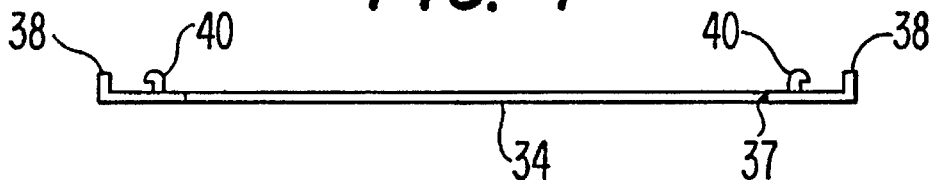
FIG. 4 is a side elevational view illustrating the frame assembly.
Figure 5:
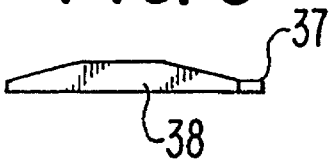
FIG. 5 is an end view of the frame assembly.
Figure 6:
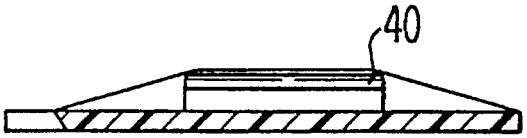
FIG. 6 is a cross-sectional view taken along the section line 6—6 appearing in FIG. 3.
Figure 7:
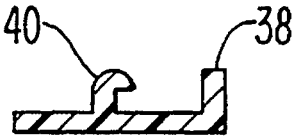
FIG. 7 is a cross-sectional view taken along the section line 7—7 appearing in FIG. 3.

Reference is made to FIG. 1 for disclosing aspects of an improved medication control and dispensing assembly 10 of the present invention. The assembly 10 includes a medicine containing carton 12 which cooperates with a frame assembly 14 in a manner to be described. The carton 12 of the illustrated embodiment has, preferably, a one-piece generally rectangular parallelpiped construction which includes a pair of sidewalls 16, opposed front and back walls 18 and 20; respectively, bottom wall 22 and a top wall or flap portion 24. It will be noted that the back wall 18 has a portion **18*a* which projects higher than the other upstanding walls. The top flap portion 24 is folded integrally with the back wall portion 18*a* so as to be foldable between open and closed positions. The carton 12 can be made from a variety of materials, but is, preferably, made of a cardboard material which therefore makes the top flap portion 24 bendable. The bendable top flap portion 24 has an upper surface 26 which is adapted to have placed thereon a label 28 including information concerning the medication, patient and other pertinent data for dispensing. The medication (not shown) to be dispensed can be in the form of pills, capsules, caplets or the like which are suitably packaged. The walls defining the carton 12 define a medication dispensing opening 30 which when opened allows access to the medication. Although not shown, it will be appreciated that the top flap portion 24 can be adhered to a side of the carton by reason of an adhesive strip (not shown), such as like that described in U.S. Pat No. 4,813,753. The top flap portion 24 is also provided with a pair of spaced-apart generally rectangular slots 32 which, as will be described, cooperate with the frame assembly 14. Moreover, at least one of sidewalls 16 of each carton 12 has a positioning slot 60 formed therein, to allow secure insertion of each carton in tray 50 in a manner described herein. Positioning slot 60** is illustrated in a generally rectangular shape, but others may be used as well.

In the illustrated preferred embodiment, the frame assembly 14 has a generally rectangular shaped configuration (FIGS. 1–3 and 8) having a cut-out portion **14*a*. The frame assembly 14 can be made of a one-piece, flexible plastic material which is adapted to be securely attached or coupled to the top flap portion 24 in a manner to be described. In this embodiment, the U-shaped frame member 14 has a generally elongated central body portion 34 which will run coextensive with the length of the top flap portion 24. The frame member 24 also has extending laterally offset therefrom two leg portions 36. The leg portions 36 are offset relative to the body to define a lifting lip 37. Each leg portion 36 is provided with an upstanding lateral edge 38 which cooperates with the edges of the top flap portion 24. It will be appreciated that the frame is intended to have a thickness cooperable with the height of wall portion 18a. In addition, there is provided a locking means or tab portion 40 upstanding integrally from each leg portion 36. The tab portions 40** are adapted to protrude through the plane of the top flap portion 24, through the relatively smaller dimensioned slots 32, and engage and removably cooperate with the topside of the top flap portion 24. In this regard, the tab portions 40 have a generally J-shaped cross-sectional configuration. The foregoing construction tends to retain the one-piece frame assembly 14 in its desired position, but also allows the tab portions 40 to be removed from the flap 24. Also, the frame assembly 14 tends to maintain the bendable top flap portion 24 in a generally planar orientation which serves to facilitate not only the opening and closing of the medication opening 30, but serves to also prevent the top flap portion from being bent or otherwise crushed during usage. While the present invention discloses the use of a J-shaped locking tab portion 40 as illustrated, it will be appreciated that the present invention envisions other configurations as well as other means for connecting the frame assembly to the top flap portion. For instance, a locking tab can have an interference fit with the slot 32. Also, the frame can be attached to either the top or bottom surface of the top panel.

Because of the foregoing construction several advantages are achieved insofar as the top flap portion 24 has its planarity stabilized, thereby preventing the top flap portion from being crushed or otherwise bent as well as facilitates easy opening and closing of the opening 30 in a manner which does not, for instance, interfere with medicine carts, cabinets, trays and the like. The construction of the assembly 10 ensures the integrity of medication dispensing.

Figure 8:
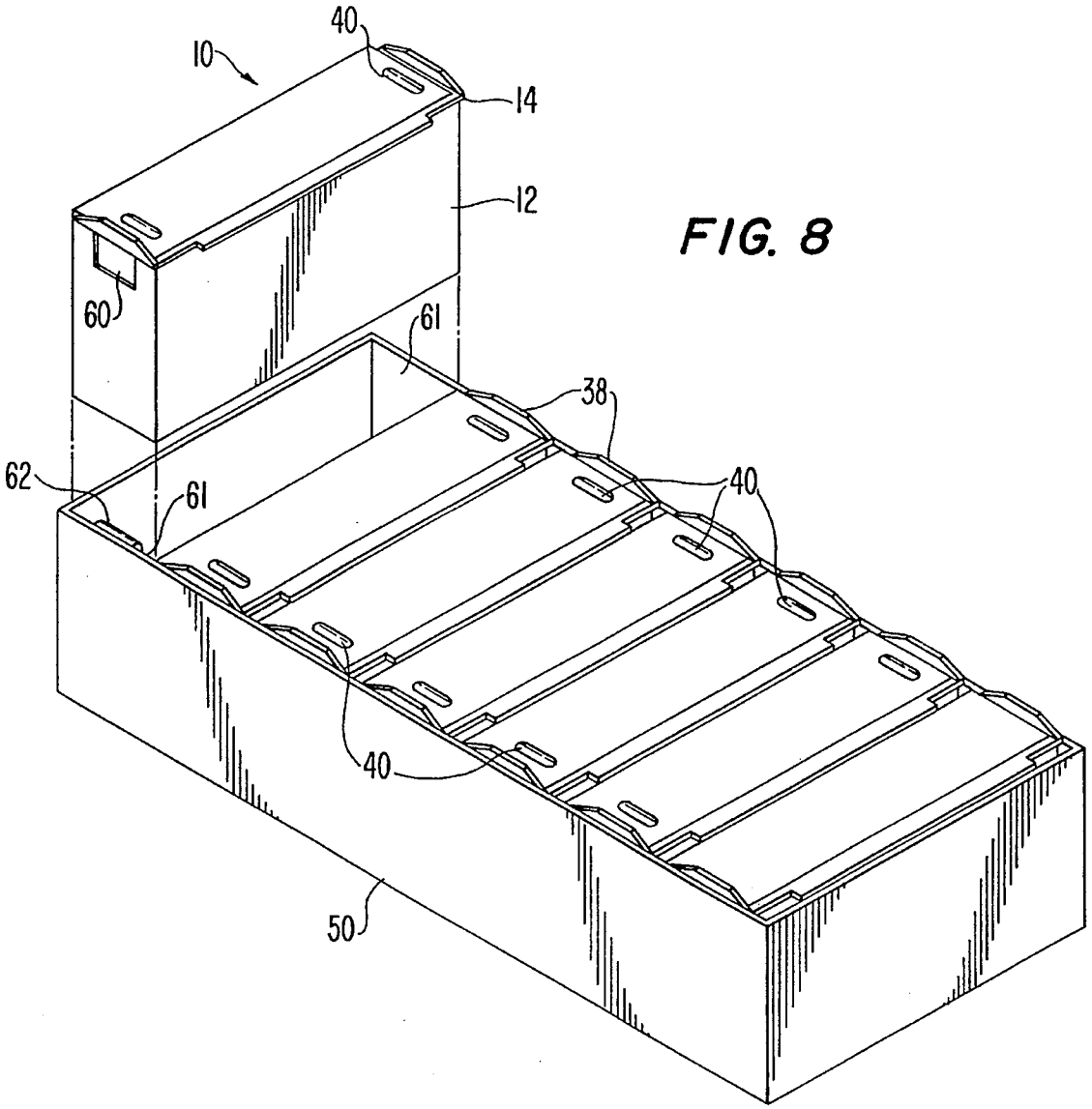
FIG. 8 is a perspective view disclosing several dispensing carton assemblies in an open tray therefor; and, FIGS. 9 and 10 are similar to FIGS. 1 and 2, but illustrate an alternate embodiment in that the frame assembly is attached to the top surface of a top flap of the carton.
Figures 11A, 11B:
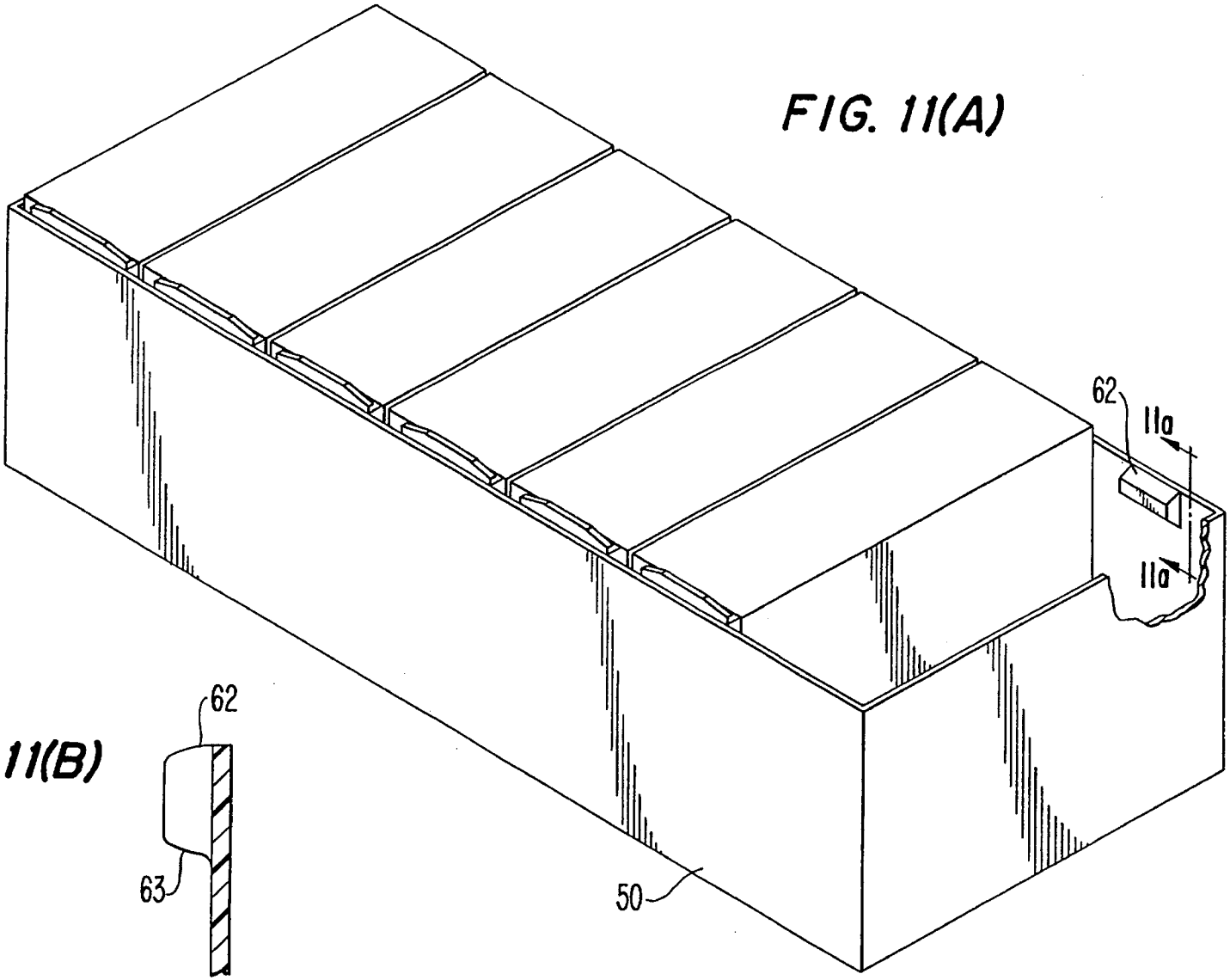
FIGS. 11(A) and 11(B) are a perspective view of the medication control and dispensing assembly of the invention showing a cutaway view of an anchoring tab in the assembly, and a cross-sectional view of the anchoring tab, respectively.
Figure 12:
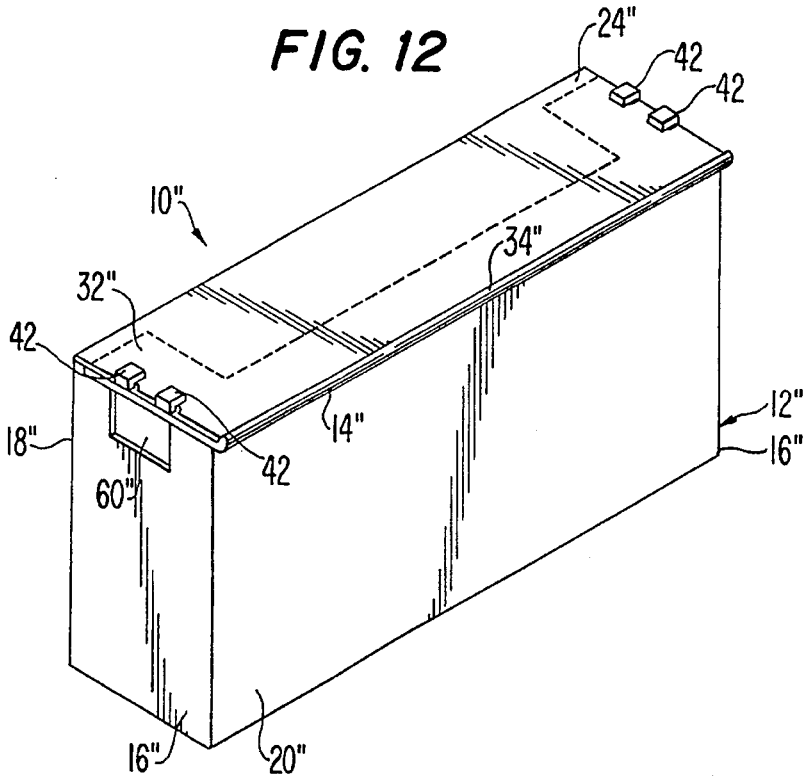
FIG. 12 is a perspective view of a second alternate embodiment of the invention, wherein the frame assembly includes coupling teeth.
Figure 13:
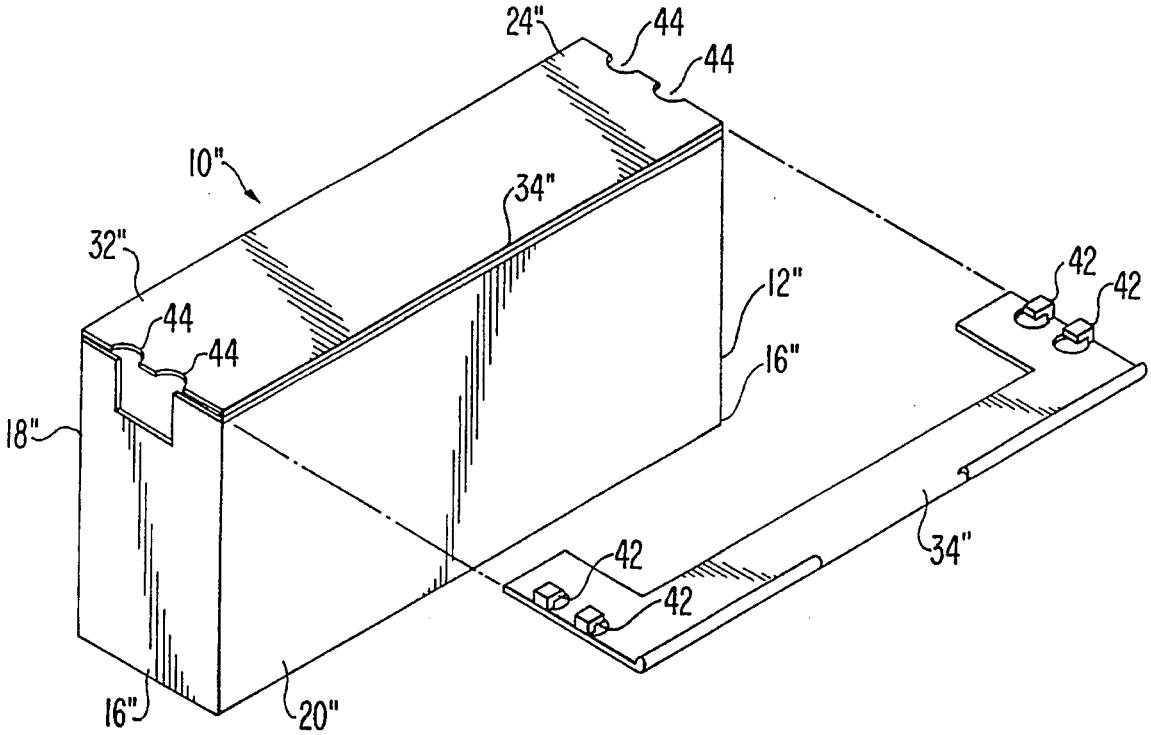
FIG. 13 is an exploded perspective view of the second alternate embodiment of the invention.
Figure 14:
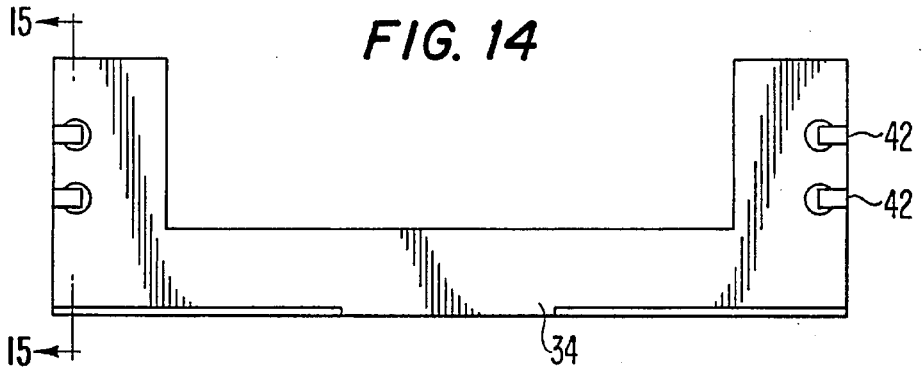
FIG. 14 is a top view of the frame assembly of the second alternate embodiment of the invention.
Figure 15:
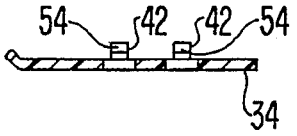
FIG. 15 is a side view of the frame assembly of the second alternate embodiment of the invention.
Figure 16:
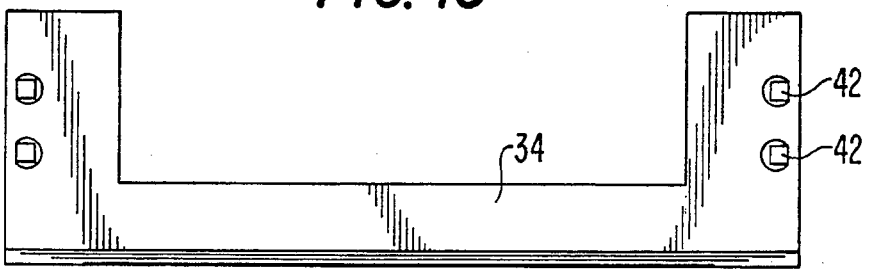
FIG. 16 is a bottom view of the frame assembly of the second alternate embodiment of the invention.

As shown in FIG. 8, the present invention also provides a tray 50 which has an open-top and is sized to accommodate several of the container and frame assemblies described above. The tray can be made of, for example, a plastic material and is adapted to be placed in a medicine cart or the like. At each position receiving a carton 12, the tray 50 has formed along the upper interior sidewall 61 thereof an anchoring tab 62, as illustrated for instance in FIGS. 11(A) and 11(B). The anchoring tab 62 is a rigid projection, preferably of a generally regular shape, which engages position slot 60 of an inserted carton. Each tab 62 may be integrally molded with tray 50, or separately inserted at desired intervals. In operation, a carton 12 is inserted with its positioning slot 60 aligned with anchoring tab 62.

Carton 12 of course is of a slightly smaller width than the width of tray 50. When carton 12 so aligned is inserted into tray 50, one or more of the at least one of the sidewalls 16 having positioning slot 60 comes into slight frictional contact with anchoring tab 62. The contact with rigid anchoring tab 62 causes sidewall 16 of carton 12 to "give" slightly, allowing carton 12 to be inserted down into the open cavity of tray 50. As carton 12 approaches full insertion into tray 50, anchoring tab 62 slides into engagement with positioning slot 60, and projects slightly into carton 12 through positioning slot 60. When such action is completed, carton 12 is held securely in place inside of tray 50, even if no other cartons are placed in tray 50. It will be appreciated that all cartons inserted into tray 50 may therefore be kept fixed in orderly front-to-back position for dispensing by a nurse, storing, etc.

Moreover, the removal of carton 12 so inserted in tray 50 remains convenient to the attendant. Sidewalls 16 have enough flexibility to allow simple grasping of carton 12 from the top for removal. Anchoring tabs may also be formed with a generally inclined lower lip 63 as illustrated in FIG. 11, to create even easier removal by increased leverage on the exterior of sidewall 16 as carton 12 is being grasped and pulled up out of tray 50. It will also be appreciated that the maintenance of fixed carton positions in the present invention is achieved without the need for any internal ribbing or dividing structure, which would add weight, expense and significant additional size to the overall dispenser assembly. Owing to the foregoing constructions there is provided an inexpensive, yet highly reliable and fixedly secure medication and package assembly.

Figure 9:
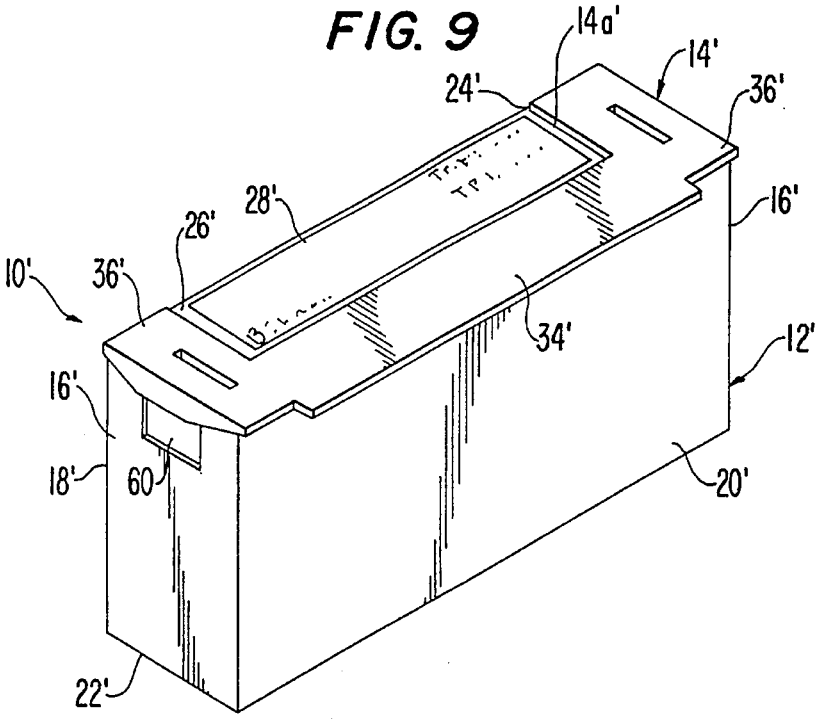
Figure 10:
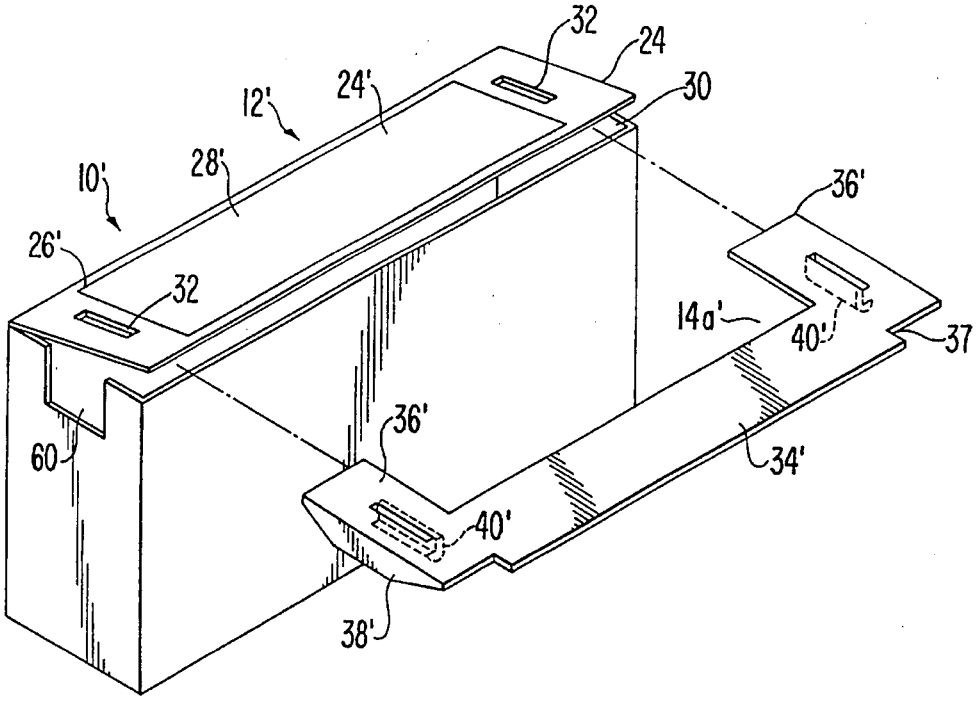

Reference is made to FIGS. 9 and 10 for disclosing a first alternate embodiment of an improved medication control and dispensing assembly of the present invention. In this first alternate embodiment like structure will be represented by like reference numerals, but with the addition of a prime marking. One difference in this first alternate embodiment is that the frame assembly 14' is assembled on the top flap portion 24. The assembly 10' includes a medicine containing carton 12' which cooperates with the frame assembly 14' in a manner to be described. The carton 12' of the illustrated first alternate embodiment has, preferably, a one-piece generally rectangular parallelpiped construction which includes a pair of sidewalls 16, also having positioning slots 16,' opposed front and back walls 18' and 20'; respectively, bottom wall 22' and a top wall or flap portion 24'. It will be noted that the back wall 18' does not have a portion **18*a* which projects higher than the other upstanding walls. The top flap portion 24 is folded integrally with the back wall portion 18*a* so as to be foldable between open and closed positions. In this first alternate embodiment the backwall projection 18*a* is not present. The bendable top flap portion 24' has an upper surface 26' which is adapted to have placed thereon a label 28' including information concerning the medication, patient and other pertinent data for dispensing. The walls defining the carton 12'define a medication dispensing opening 30' which when opened allows access to the medication. In addition, the top flap portion 24' is provided with a pair of spaced-apart generally rectangular slots 32' which, as will be described, cooperate with the frame assembly 14'**.

In the illustrated first alternate embodiment, the frame assembly 14' has a generally rectangular shaped configuration (FIGS. 9 and 10) having a cut-out portion **14*a*'. In this embodiment, the U-shaped frame member 14' has a generally elongated central body portion 34' having extending laterally offset therefrom two leg portions 36'. The leg portions 36' are offset relative to the body to define a lifting lip 37'. Each leg portion 36' is provided with a depending lateral edge 38' which cooperates with the edges of the top flap portion 24'. In addition, there is provided a releasable locking means or tab portion 40' depending integrally from each leg portion 36'. The tab portions 40' are adapted to protrude through the plane of the top flap portion 24', through the slots 32', and engage and cooperate with the underside of the top flap portion 24'. In this regard, tab portions 40' have a generally J-shaped configuration. The foregoing construction tends to retain the one-piece frame assembly 14' in its desired position. Also, frame assembly 14' tends to maintain the bendable top flap portion 24' in a generally planar orientation which serves to facilitate not only the opening and closing of the medication opening 30', but serves to also prevent the top flap portion from being bent or otherwise crushed during usage. In addition, the cut-out 14*a*' configuration permits use of a reorder label that does not require the flap portion 24' to be released from the frame. That is, the lid frame is attached below the flap 24' so the label is not obscured, but is instead always exposed for easy re-order. This is in contrast to prior art such as U.S. Pat. No. 4,813,753 which describes a lid that covers and obscures the label and must be removed to gain access to the re-order label. In the first alternate embodiment thereby described, each anchoring tab 62 similarly engages positioning slots 16' to provide secure fixation of carton 12' in tray 50**, with all of the attendant advantages described above in connection with the first embodiment.

Reference is made to FIGS. 12–16 for disclosing a second alternate embodiment of an improved medication control and dispensing assembly of the present invention, particularly modified in elongated body portion 34", and corresponding coupling means. In this second alternate embodiment like structure will be represented by like reference numerals, but with a double prime marking. One structural difference in this second alternate embodiment is that the frame assembly 14" has a pair of projecting teeth 42 disposed on opposite ends of the frame assembly 14", in place of tab portion 40. Projecting teeth 42 include overhang portions 54 which in the illustrated second alternate embodiment face the center of the frame assembly 14".

The assembly 10" similarly includes a medicine containing carton 12" which cooperates with the frame assembly 14". The carton 12" of the illustrated second alternate embodiment likewise has, preferably, a one-piece generally rectangular parallelpiped construction which includes a pair of sidewalls 16", and may also have positioning slots 60 along with opposed front and back walls 18" and 20", respectively; bottom wall 22" and a top wall or flap portion 24". As in the other embodiments, the top flap portion 24" is folded integrally with the back wall portion **18*a*"** so as to be foldable between open and closed positions.

The bendable top flap portion 24" has an upper surface 26" which is similarly adapted to have placed thereon a label 28'. The walls defining the carton 12" define a medication dispensing opening 30" which, when opened, allows access to the medication, in like manner.

In addition, top flap portion 24" is provided with a pair of spaced-apart, generally semicircular slots 44 which, as will be described, cooperate with the frame assembly 14" to secure attachment of the carton 12" to the frame assembly 14".

In the illustrated second alternate embodiment, the frame assembly 14" is provided with a releasable locking means, here, projecting teeth 42. The projecting teeth 42 are adapted to protrude through the plane of the top flap portion 24", and to engage semicircular slots 44 upon insertion of the top flap portion 24" into frame assembly 14". In this regard, when carton 12" is made of cardboard or the like, a slight amount of flex assists in locking semicircular slots 44 into engagement with projecting teeth 42. Because projecting teeth 42 in the illustrated second alternate embodiment engage semicircular slots 44 from an outside position, removal of the top flap portion 24" from frame assembly 14" can be accomplished by gently tugging top flap portion 24" in an upward direction, causing top flap portion 24" to flex slightly and slide out of engagement with semicircular slots 44, making removal highly convenient.

At the same time, the foregoing construction retains the one-piece frame assembly 14" in locking engagement in its desired position. Also, frame assembly 14" similarly tends to maintain the bendable top flap portion 24" in a generally planar orientation, facilitating opening and closing of the medication opening 30" and preventing the top flap portion 24" from being bent or otherwise crushed during use. Cut-out **14*a*" configuration likewise permits use of a reorder label that does not require the flap portion 24"** to be released from the frame.

In the second alternate embodiment thereby described, each anchoring tab 62 when provided, similarly engages positioning slots 60 to provide secure fixation of carton 12" in tray 50" with all of the attendant advantages described above in connection with the other embodiments.

Figure 17:
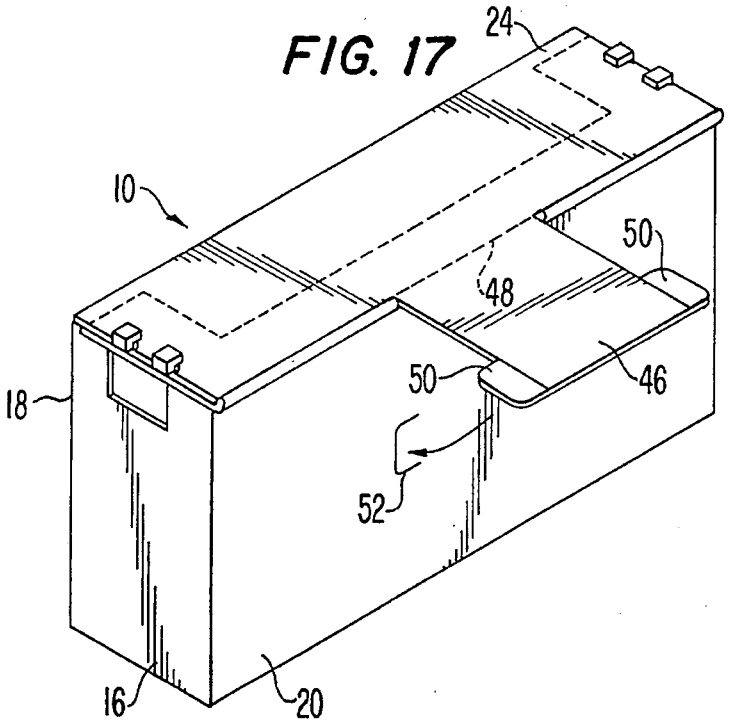
FIG. 17 is a perspective view of the frame assembly of the invention provided with a closing flap.

In any of the foregoing illustrated embodiments, it is also possible, as illustrated in FIG. 17, to provide top wall (bendable flap) 24 with a closing flap 46, which is radially or bendably attached to the elongated body portion 34 at a joint 48. Closing flap 46 may be bent to secure the bendable flap portion 24 into a closed position by releasably inserting closing tabs 50 into receiving slots 52 in back wall 20 of the dispensing assembly 10. This allows even more secure transport, handling and storage of dispensing assembly 10, since the contents of the dispensing assembly is effectively lockably contained by engagement of closing flap 46 with receiving slots 52.

Changes may be made in the construction of the various elements, parts, and assemblies described herein without departing from the spirit and scope of the present invention, the scope of which is defined only in the following claims.

What is claimed is:

1. A medication control and dispensing assembly comprising:

a medication dispensing carton having carton walls defining a medication dispensing opening, a top wall portion made of bendable material and being connected to a portion of said carton walls in such a manner so as to be movable between a closed condition covering said medication opening and open conditions so as to permit withdrawal of medication from said carton, said top wall portion having connecting means adapted for connection with a frame two of said carton walls being opposed and defining first and second carton side walls, at least one of said first and second carton side walls having a positioning slot formed therein;

said frame having support means cooperating with said top wall portion for retaining the configuration of said top wall portion, support means including at least a pair of upstanding releasable locking tabs which cooperate with said connecting means of said top wall portion so as to removably lock said frame means to said top wall portion said connecting means including slots adapted to each removably receive a corresponding one of said tabs; and a tray, having walls defining an opening for insertion and removal of said medication dispensing carton, two of said walls defining tray side walls and at least one of said tray side walls having an anchoring tab at an interior portion thereof, said anchoring tab slideably engaging said positioning slot of said at least one of said first and second carton side walls to hold said medication dispensing carton at a substantially fixed position.

2. A medication control and dispensing assembly comprising:

a medication dispensing carton having carton walls defining a medication dispensing opening, a top wall portion made of bendable material and being connected to a portion of said carton walls in such a manner so as to be movable between a closed condition covering said medication opening and open conditions so as to permit withdrawal of medication from said carton, said top wall portion having connecting means adapted for connection with a frame, two of said carton walls being opposed and defining first and second carton side walls, at least one of said first and second carton side walls having a positioning slot formed therein;

said frame having a pair of edge supports, each of said edge supports being adapted to rest against on said top flap portion, said frame further having a lifting lip portion; and a tray, having walls defining an opening for insertion and removal of said medication dispensing carton, two of said walls defining tray side walls and at least one of said tray side walls having an anchoring tab at an interior portion thereof, said anchoring tab slideably engaging said positioning slot of said at least one of said first and second carton side walls to hold said medication dispensing carton at a substantially fixed position.

3. A medication control and dispensing assembly comprising:

a medication dispensing canon having canon wails defining a medication dispensing opening, a top wail portion made of bendable material and being connected to a portion of said carton walls in such a manner so as to be movable between a closed condition covering said medication opening and open conditions so as to permit withdrawal of medication from said carton, said top wall portion having connecting means adapted for connection with a frame two of said carton walls being opposed and defining first and second carton side wails, at least one of said first and second canon side wails having a positioning slot formed therein;

said frame cooperating with said top wall portion for retaining the configuration of said top wail portion, said frame having at least a pair of upstanding releasable locking teeth, said connecting means including connecting slots adapted to each removably receive a corresponding one of said teeth; and a tray, having wails defining an opening for insertion and removal of said medication dispensing canon, two of said wails defining tray side wails and at least one of said tray side walls having an anchoring tab at an interior portion thereof, said anchoring tab slideably engaging said positioning slot of said at least one of said first and second canon side wails to hold said medication dispensing canon at a substantially fixed position.

4. A medication control and dispensing assembly comprising:

a medication dispensing carton having carton walls defining a medication dispensing opening, a top wall portion made of bendable material and being connected to a portion of said carton walls in such a manner so as to be movable between a closed condition covering said medication opening and open conditions so as to permit withdrawal of medication from said carton, said top wall portion having connecting means adapted for connection with a frame two of said carton walls being opposed and defining first and second carton side walls, at least one of said first and second carton side walls having a positioning slot formed therein a closing flap attached to said top wall portion and closing slots in at least one of said walls, said closing flap releasably engaging said closing slots to secure the assembly in a closed position; and a tray, having walls defining an opening for insertion and removal of said medication dispensing carton, two of said walls defining tray side walls and at least one of said tray side walls having an anchoring tab at an interior portion thereof, said anchoring tab slideably engaging said positioning slot of said at least one of said first and second carton side walls to hold said medication dispensing carton at a substantially fixed position.

5. An assembly, comprising:

an open top tray assembly, having walls, constructed to removably receive at least one medication control and dispensing assembly held substantially in a fixed position, and having at least one anchoring tab on an interior surface of one of said walls;

a medication control and dispensing assembly comprising:

a medicine dispensing carton having carton wails defining a medication dispensing opening, and a top wail portion made of bendable material and being connected to a portion of said carton walls in such a manner so as to be movable between a closed condition covering said medication opening and open conditions so as to permit withdrawal of medication from said carton, said top wall portion comprising connecting means adapted for connection with a frame.

said frame including retaining means removably couplable with said connecting means, said frame cooperating with said top wail portion for retaining the configuration of said top wail portion, said retaining means comprising at least a pair of spaced-apart upstanding releasable locking tabs which cooperate with said connecting means of said top wail portion so as to removably lock said frame to said top wail portion, said connecting means including connecting slots adapted to each removably receive a corresponding one of said tabs at least one of said carton side wails having a positioning slot slideably engaging said at least one anchoring tab to hold said medication dispensing carton at a substantially fixed position.

6. An assembly comprising:

an open top tray assembly, having walls, constructed to removably receive at least one medication control and dispensing assembly held substantially in a fixed position, and having at least one anchoring tab on an interior surface of one of said walls;

a medication control lined dispensing assembly comprising:

a medicine dispensing carton having carton walls defining a medication dispensing opening, and a top wall portion made of bendable material and being connected to a portion of said carton walls in such a manner so as to be movable between a closed condition covering said medication opening and open conditions so as to permit withdrawal of medication from said carton, said top wall portion comprising connecting means adapter for connection with a frame.

said frame including retaining means removably couplable with said connecting means, said frame cooperating with said top wall portion for retaining the configuration of said top wall portion, said retaining means comprising at least a pair of spaced-apart releasable locking teeth, said connecting means including connecting slots adapted to each removably receive a corresponding one of said teeth, at least one of said carton side walls having a positioning slot slideably engaging said at least one anchoring tab to hold said medication dispensing carton at a substantially fixed position.

7. An assembly comprising:

an open top tray assembly, having walls, constructed to removably receive at least one medication control and dispensing assembly held substantially in a fixed position, and having at least one anchoring tab on an interior surface of one of said walls;

a medication control and dispensing assembly comprising:

a medicine dispensing carton having canon walls defining a medication dispensing opening, and a top wall portion made of bendable material and being connected to a portion of said carton walls in such a manner so as to be movable between a closed condition covering said medication opening and open conditions so as to permit withdrawal of medication from said carton, said top wall portion comprising connecting means adapted for connection with a frame, a closing flap attached to said top wall portion and closing slots in at least one of said walls, said closing flap releasably engaging said closing slots to secure the assembly in a closed position, at least one of said carton side walls having a positioning slot slideably engaging said at least one anchoring tab to hold said medication dispensing carton at a substantially fixed position.

* * * * *